United States Patent [19]

Mahowald

[11] 4,418,825

[45] Dec. 6, 1983

[54] DEVICE FOR HOLDING SOFT-COVERED BOOKS

[76] Inventor: John E. Mahowald, 1401 Klepper Ave., Kingsburg, Calif. 93631

[21] Appl. No.: 318,325

[22] Filed: Nov. 5, 1981

[51] Int. Cl.[3] ..... A47B 65/00

[52] U.S. Cl. ..... 211/42; 248/441 D; 248/359; 281/15 A

[58] Field of Search ..... 211/45, 42, 46; 248/163 A, 121, 441 D, 441 B, 359; 281/45, 15 A, 15 B; 312/184, 233

[56] References Cited

U.S. PATENT DOCUMENTS

| | | | |
|---|---|---|---|
| 2,165,157 | 7/1939 | Smith | 312/184 |
| 2,627,981 | 2/1953 | Bitney | 211/181 X |
| 3,159,369 | 12/1964 | Wiczer | 248/301 X |
| 3,228,648 | 1/1966 | Tils | 312/233 X |
| 3,275,279 | 9/1966 | Caldwell et al. | 312/233 X |
| 3,826,582 | 7/1974 | Podosek | 281/15 A X |
| 4,155,607 | 5/1979 | Sitler et al. | 211/46 X |
| 4,255,065 | 3/1981 | Errichiello | 281/45 X |
| 4,315,572 | 2/1982 | Clare | 211/45 |

FOREIGN PATENT DOCUMENTS

| | | | |
|---|---|---|---|
| 1327218 | 12/1963 | France | 281/15 A |
| 624746 | 6/1949 | United Kingdom | 411/522 |

*Primary Examiner*—J. Franklin Foss
*Assistant Examiner*—David L. Talbott
*Attorney, Agent, or Firm*—Manfred M. Warren; Robert B. Chickering; Glen R. Grunewald

[57] ABSTRACT

A device for supporting a soft-cover book having a stiff spine including a hook to extend from a slit in the spine, a locking element beneath the hook to engage the slit in the spine and a support element that is connected to the locking element and extends beyond it in two directions, the support element being adapted to support the book by its spine and to lie between adjacent pages in the book, with the whole device made of flat sheet material not thicker than 1.2 millimeters.

5 Claims, 3 Drawing Figures

DEVICE FOR HOLDING SOFT-COVERED BOOKS

BACKGROUND OF THE INVENTION

Flexible, soft-covered books with stiff spines, such as telephone directories and catalogs, are difficult to store on shelves. Books with stiff spines but limp pages and covers slump or collapse when placed on ordinary book shelves so that they become misshapen, they are difficult to use, and they are unsightly. In fact, storing a number of such catalogs or directories on shelves is accomplished by stacking them flat, one upon another. However, books stacked upon one another are difficult to remove and replace.

SUMMARY OF THE INVENTION

This invention is a device for holding soft-covered books vertically in a manner such that each can be removed, used, and replaced independently and held vertically without slumping, folding or collapsing. An important feature of the invention is that the device of this invention is installed in a book and remains in the book throughout the useful life of the book after which it may be removed. While in the book during its useful life, the book can be stored, removed, replaced, and used normally with the device in it, and the use of the book with the device in it does not cause the device to become dislodged.

Although the device of this invention may be, and preferably is, a unitary device made from a single piece of metal, it has three distinct functional areas. One functional area, which in ordinary use is the upper area, is a hook element. Because the device of this invention is a hook that is normally suspended from a bar, terms such as upper, lower, vertical and horizontal are used with the connotation of the position of the device in normal use.

The hook element, as with most hooks, has an interior opening and a side opening that opens through the side of the hook element into the interior opening. The device of this invention is normally used in combination with a rod, and the radius of the upper portion of the interior opening of the hook element is at least as large, and preferably larger than the radius of the rod that is employed in combination with it. In a preferred embodiment of the invention, the bottom of the interior opening and the interior side of the hook element that is opposite the side opening, together form a smooth curve that has the effect of a cam so that when the hook element is moved toward the rod from which the hook is suspended, contact between the hook element and the rod will urge the hook element downwardly so that the upper portion of the interior opening of the hook element comes in contact with the rod in the natural position it will be when the device is suspended from the rod.

The hook element is the narrowest portion of the device and preferably tapers to become narrower from the bottom of the hook element toward the top. In a preferred embodiment, the exterior of the hook element that is opposite the open side tapers on a straight line toward the upper portion of the hook element to make it easier to insert in a slit in the spine of a soft cover book.

A second portion of the device of this invention is a locking element. The locking element is adjacent to the base of the hook element and in fact, in a preferred embodiment of the invention, a sharp delineation between the locking element and the hook element cannot be seen. The function of the locking element is to hold the device of this invention firmly in the proper place in the spine of a book when it is employed to hold a soft-covered book. At least some portion of the locking element is at least as wide, and preferably wider, than any portion of the hook element, and the lowermost portion of the locking element is provided with lateral recesses to interlock with the spine of the book when the device is in place. It is also a preferred embodiment of the invention that the locking element is provided with ears that are bent out of the plane of the locking element to provide third-dimensional aspects to the device to increase its ability to interlock with the spine of a book.

A third element of the device is a supporting element which is positioned immediately adjacent and immediately below the locking element. The supporting element is wider than the locking element, preferably at least twice as wide as the locking element, and it extends laterally from both sides of the locking element. Preferably, the supporting element extends a distance about equal to the width of the locking element on each side of it. The supporting element must be strong enough to hold the weight of the book being supported and it preferably has very small vertical extent compared with its horizontal extent so that it will not interfere with utility of the book when one is consulting one of the pages that the supporting element lies between. The supporting element may be provided with means to increase its utility, such as, having holes of a size and spacing to accept standard file binders.

The device of this invention must be made from material that is thin. In order to be useful without distorting the shape of a book that is to be suspended by it, the device of this invention must be not greater than about 0.05 inches (about 1.2 millimeters) thick and, the entire device must lie substantially in the same plane. Although small portions of the locking element may not lie in the same plane as the rest of the device, these elements must be very small in area compared with the area of the remainder of the device and the extent that they lie out of the plane of the rest of the device must be very limited.

DESCRIPTION OF THE DRAWINGS

This invention and the manner for using it may be better understood with reference to the accompanying drawings.

Referring to FIGS. 1 and 2, the device of this invention includes a hook element generally designated 10. The hook element includes an interior opening 11 and a side opening 12. The bottom portion 13 of side opening 12 merges into the rear portion 15 of the interior opening to form a smooth cam-shaped curve that urges hook element 10 into its proper position as it is forced against a bar from which it will hang. The radius of the upper curve portion of the interior opening 11 must be larger than the radius of the rod from which the hook is to hang and, preferably, it is substantially larger so that there will be no binding either when the hook placed on or removed from the suspending bar. If the device of this invention is to be used in a public place, for example to support a telephone directory or catalog in a shopping area, an additional hole 16 may be provided in the device for connecting it to a cable or a chain to prevent either the device or the book that it supports from being stolen.

Figure 1:
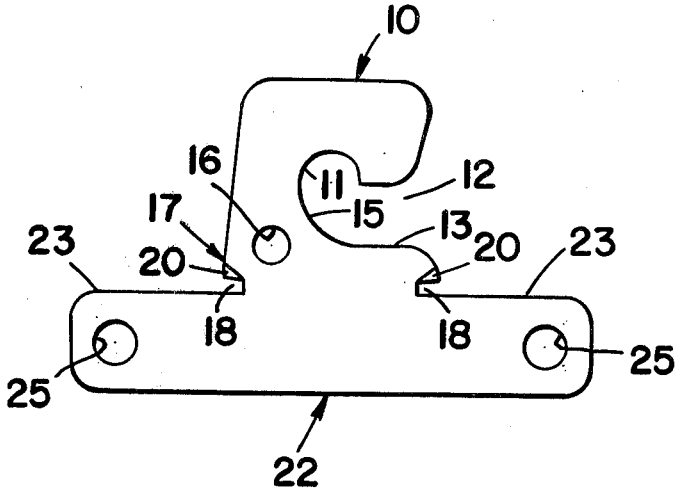
FIG. 1 is an elevation view of the device of this invention as it would be seen in normal use.
Figure 2:
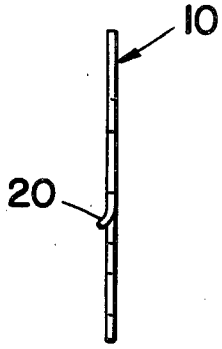
FIG. 2 is a right end view of the device illustrated in FIG. 1.

The portion of the device of this invention immediately below the hook element is a locking element, generally designated 17. There is no distinct line between the hook element and the locking element because one merges into the other in the illustrated device. The characteristics of the locking element are that it is immediately adjacent the hook element, at least some portion of the locking element is as wide or wider than the hook element, and the locking element includes recesses 18. In a preferred embodiment of the invention the locking element 17 includes bent ears 20 which may extend from the plane of the device of this invention in the same direction, as illustrated in FIG. 2, or which may both be bent to extend from the plane of the device of this invention in opposite directions.

The device of this invention also includes a support element generally designated 22. The support element extends laterally from both sides of the locking element and it includes an edge 23 on each lateral extension, the edges 23 being perpendicular to the vertical axis of the device so that they are horizontal when the device is in use. The vertical extent of support element 22 is quite limited, and it preferably is as small as is reasonable given the ability of the material from which it is made to support the weight of the book it is to be used with. Support element 22 may include holes 25 having a suitable diameter and distance between them to be used with file binders whereby the device of this invention may be employed to support files by hanging them from a bar or to support books by the top of their covers rather than by their spines.

The device of this invention must be made of thin sheet or plate material not exceeding about 0.05 inches (1.27 millimeters) in thickness. Typically, the device of this invention is made from sheet metal but it may be made from plastic or it may be made of composite material. The material from which the device is made is selected on the basis of being strong enough to support the anticipated load in a form that is no greater than 0.05 inches thick. In normal use the hook element and the locking element extend above the spine of the book while the supporting element is caught between the pages of the book to bear against the underside of the spine. As such, the weight of the book itself as it embraces the supporting element between pages prevents the supporting element from buckling or distorting while the hook element and the locking element are subjected mostly to tensile forces so that the flat, thin shape of the device does not influence its ability to perform its function.

Figure 3:
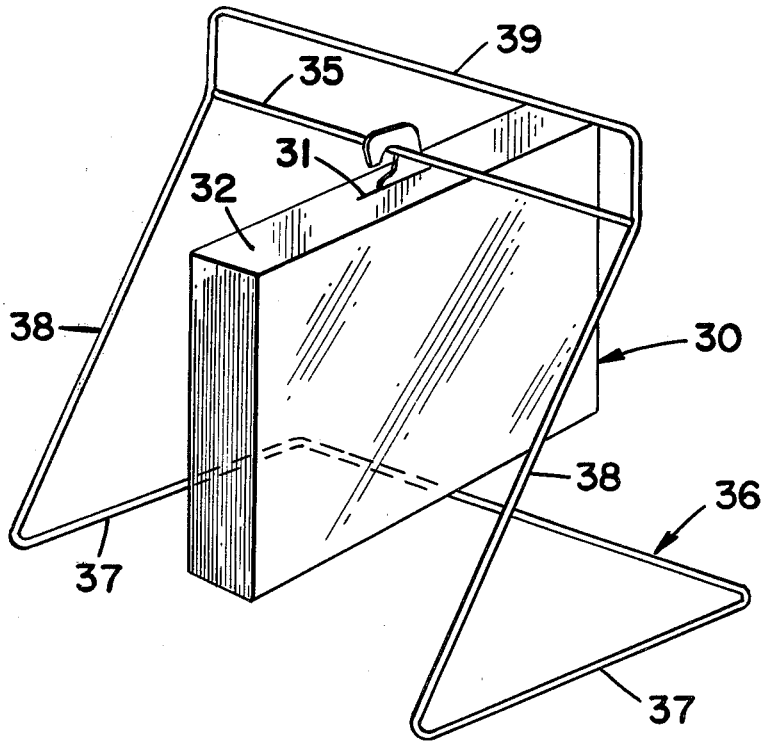
FIG. 3 is a perspective view of the device of this invention as it would appear in use.

FIG. 3 illustrates a perspective view of the device of this invention in use. In FIG. 3 a soft-cover book such as a telephone directory is generally designated 30. The device of this invention provides a means for supporting the book 30 from a bar 35. The device of this invention is installed in an ordinary book such as a telephone directory by opening the book approximately to its center pages and by cutting a slit 31 through the spine 32 of the book. The slit is normally cut from the inside of the book toward the outside of the spine. The slit 31 is slightly wider than the maximum width of locking element 17 and the tapered shape of the hook element causes the insertion of the device of this invention through the slit 31 to be easily accomplished because the upper part of the hook is substantially smaller than slit 31. Normally the spine of a book, such as a soft-covered directory, will be flexible enough for ears 20 to pass through slit 31, after which it will spring back to its original position whereby ears 20 will catch on the spine and prevent the device of this invention from accidentally falling from slit 31 when the book is being used. In addition, the device of this invention will normally move in slit 31 so that one or the other of recesses 18 will engage the outside of the spine thereby further preventing the device of this invention from being accidentally dislodged from slit 31. A narrow slit 31 does not in any way weaken the spine of the book, nor does it diminish its useful life. The supporting element, being no thicker than 0.05 inches, does not cause enough separation of adjacent pages between which it is placed to distort the appearance or the utility of the book. In fact, with the device of this invention in place in a telephone directory, it is difficult to find the two pages between which the supporting element is placed. The supporting element being of narrow vertical extent usually will not obscure any of the printing on a page where it is placed but in any event, it can be readily moved to be out of contact with a page so that no page is obscured in a book in which the device of this invention is used. If the device is made from transparent plastic, it is not even necessary to move the supporting element in order to read the page where it is maintained.

The rod 35 may be suspended from the underside of a bookshelf, it may be cantilevered from a wall bracket or in a preferred embodiment, it may be a portion of a free standing support as illustrated in FIG. 3. Rod 35 must be strong enough to support the book or books suspended from it. It is evident that directory 30 illustrated in FIG. 3 will be absolutely vertical in orientation when suspended by the device of this invention, that the stiff spine 32 will not slump or bend, that neither the covers nor the pages will be distorted by the device of this invention, and that the book can be removed from and replaced on rod 35 without injury or disturbance of adjacent books if it is one of a number of books to be so suspended from rod 35.

The embodiment of FIG. 3 is a particularly preferred embodiment of this invention. FIG. 3 illustrates a free-standing support generally designated 36 which includes, in addition to bar 35, a surface engaging portion 37, a support portion 38, and a carrying handle 39, which is vertically spaced above rod 35 sufficiently to permit easy grasping of handle 39. In a preferred form, the free-standing support 36 is made of bent metal bar and support portion 38 is long enough to hold rod 35 high enough above the supporting surface to permit book 30 to be suspended. The configuration of support portion 38 is such that rod 35 is vertically above the center portion of engaging portion 37 to create a stable structure when books such as book 30 are in place.

The free-standing support may be made of wood, plastic or combinations of materials in accordance with this invention.

What is claimed is:

1. A device to suspend a soft-cover book having a stiff spine from a rod comprising:

A. a hook element having an interior rounded opening with a radius larger than the radius of said rod, having a side opening from said interior opening through a side of said hook element, said side opening being large enough to admit said rod, with said hook element being narrower at the top than at the base thereof;

B. a locking element adjacent the base of the hook element, said locking element having an upper portion at least as wide as the base of said hook element and having a lower recess adapted to embrace the spine of said book;

C. a supporting element adjacent said locking element, said supporting element being wider than said locking element, extending laterally from both sides of said locking element, and having an upper edge that is perpendicular to the vertical axis of said hook element;

D. all of said elements being thinner than about 0.05 inches and lying substantially in the same plane; and E. an ear adjacent said recess portion bent out from the plane in which all of the elements lie.

2. The device of claim 1 wherein the portion of said hook element adjacent said side opening is cam-shaped to guide said hook downwardly when forced against said rod.

3. The device of claim 1 wherein the side of said hook element opposite said side opening tapers from the base to the top on a straight line.

4. A device to suspend a soft-cover book having a stiff spine from a rod comprising a free standing support having a surface engaging element, a support portion having vertical extent, a book supporting rod held by said support portion a distance above said surface engaging element at least as great as the width of a book to be suspended, a handle held by said support portion a distance above said rod great enough to admit a hand between said rod and said handle, and a device to suspend a book by its spine said device including a hook element having an interior rounded opening with a radius larger than the radius of said rod, having a side opening from said interior opening through a side of said hook element, said side opening being large enough to admit said rod, with said hook element being narrower at the top than at the base thereof, a locking element adjacent the base of the hook element, said locking element having an upper portion at least as wide as the base of said hook element and having a lower recess adapted to embrace the spine of said book; a supporting element adjacent said locking element, said supporting element being wider than said locking element, extending laterally from both sides of said locking element, and having an upper edge that is perpendicular to the vertical axis of said hook element; all of said elements being thinner than about 0.05 inches and lying substantially in the same plane, and an ear adjacent said recess portion bent out from the plane in which all of the elements lie.

5. The device of claim 4 made from bent rod wherein said surface engaging element and said support portion are made from a single length of bent rod.

* * * * *